US005586945A

United States Patent [19]

Vonderhaar

[11] Patent Number: 5,586,945

[45] Date of Patent: Dec. 24, 1996

[54] GOLF PUTTING TRAINER

[76] Inventor: James D. Vonderhaar, 324 Woodside Dr., Bloomingdale, Ill. 60108

[21] Appl. No.: 589,299

[22] Filed: Jan. 22, 1996

[51] Int. Cl.[6] ..... A63B 69/36

[52] U.S. Cl. ..... 473/258; 473/261

[58] Field of Search ..... 473/258, 261

[56] References Cited

U.S. PATENT DOCUMENTS

| | | | |
|---|---|---|---|
| 3,460,837 | 8/1969 | Cassa, Jr. | 273/186 |
| 3,482,838 | 12/1969 | Gibson et al. | 273/186 |
| 3,510,136 | 5/1970 | Ruspoli | 473/261 X |
| 3,806,133 | 4/1974 | Cork | 273/192 |
| 3,857,570 | 12/1974 | Gutierrez et al. | 273/186 C |
| 4,230,319 | 10/1980 | Lindner | 273/192 |
| 4,423,875 | 1/1984 | Miller | 273/186 |
| 4,437,669 | 3/1984 | Pelz | 273/186 C |
| 4,563,010 | 1/1986 | McDorman et al. | 273/187 R |
| 4,634,131 | 1/1987 | Vella et al. | 273/192 |
| 4,736,952 | 4/1988 | Taft et al. | 273/183 E |
| 4,900,030 | 1/1990 | Houtz | 273/183 E |
| 4,928,975 | 5/1990 | Skelley et al. | 273/186 |
| 5,273,284 | 12/1993 | Montgomery | 273/187.6 |
| 5,423,548 | 6/1995 | Bricker | 473/258 |
| 5,433,445 | 7/1995 | Melancon | 273/186.1 |

FOREIGN PATENT DOCUMENTS

WO93/14832 8/1993 WIPO .

*Primary Examiner*—George J. Marlo
*Attorney, Agent, or Firm*—Dressler, Goldsmith, Milnamow & Katz, Ltd.

[57] ABSTRACT

A training device useful with a putter having a head and a shaft extending from the head has a sight line, which may be delineated by a taut string, and two rails for guiding the shaft as the putter is swung through a limited range defined by the rails. The limited range includes an intermediate position, in which the head of the putter is positioned in a lowermost position, a subrange of back-swing positions, in which the head of the putter is raised from the lowermost position, and a subrange of follow-through positions, in which the head is raised from the lowermost position. Each rail has a guiding surface. The rails are adapted to be adjustably curved into any of various configurations such that the shaft when guided along the guiding surfaces is positioned in a position farthest from the sight line when the putter is positioned in the intermediate position with the head positioned in the lowermost position and such that the shaft is positioned in positions closer to the sight line when the putter is swung through either subrange with the head raised from the lowermost position. The rails are arranged such that an imaginary line tangent to the guiding surfaces of the rails, in an imaginary plane intersecting the rails at any position within the limited range, is inclined approximately at a constant inclination relative to a horizontal plane. The rails are adjustable so as to adjust the constant inclination.

11 Claims, 4 Drawing Sheets

GOLF PUTTING TRAINER

TECHNICAL FIELD OF THE INVENTION

This invention pertains to a device that is useful for training a golfer to use a putter correctly. The training device comprises means for delineating a sight line and means for guiding the shaft of a putter in a novel manner.

BACKGROUND OF THE INVENTION

As exemplified in prior patents and patent applications, many prior devices have been proposed for training a golfer to use a putter correctly. Most of those devices are designed to train a golfer to employ arm movements that tend to be more forced than natural.

As exemplified in Cork U.S. Pat. No. 3,806,133, Vella et al U.S. Pat. No. 4,634,131, and Grant et al. International (PCT) Publication No. WO 93/14832, some of those devices require the shaft of the putter to be mechanically connected to a rod, wire, or rail and may require the putter to be specially configured. As exemplified in Gutierrez et al. U.S. Pat. No. 3,857,570, Skelley et al. U.S. Pat. No. 4,928,975, and Montgomery U.S. Pat. No. 5,273,284, others do not require the putter to be mechanically connected or to be specially configured.

Comprising improvements over such prior devices, this invention reflects insights that are not reflected in such prior devices, namely insights regarding arm movements that tend to be more effective for a golfer who is swinging a putter, as compared to arm movements required by such prior devices.

SUMMARY OF THE INVENTION

This invention provides a training device for training a golfer to use a putter correctly. Conventionally, the putter has a head and a shaft extending from the head. Broadly, the training device comprises two associated means, namely means for delineating a sight line and means for guiding the shaft of the putter as the putter is swung through a limited range. The limited range includes an intermediate position, in which the head of the putter is positioned in a lowermost position, a subrange of back-swing positions, in which the head of the putter is raised from the lowermost position, and a subrange of follow-through positions, in which the head of the putter is raised from the lowermost position.

The guiding means includes a rail defining the limited range and having a guiding surface, along which the shaft of the putter is guided with the head below the sight line. The shaft is biased gravitationally against the guiding surface and is slidable along the guiding surface. The rail is curved into a given configuration such that the shaft when guided along the guiding surface is in a position farthest from the sight line when the putter is positioned in the intermediate position with the head positioned in the lowermost position and such that the shaft is positioned in positions closer to the sight line when the putter is swung through the subrange of back-swing positions with the head raised from the lowermost position. Preferably, the rail is curved into the given configuration such that the shaft when guided along the guiding surface also is positioned in positions closer to the sight line when the putter is swung through the subrange of follow-through positions with the head raised from the lowermost position.

In a preferred embodiment, the rail is adapted to be adjustably curved into any of various configurations such that the shaft when guided along the guiding surface is positioned in the respective positions noted above. Further, the rail is one of a pair of similar rails, each having such a guiding surface, the rails being curved similarly and being spaced from each other. Moreover, the rails are arranged such that an imaginary line tangent to the guiding surfaces of the rails, in an imaginary plane intersecting the rails at any position within the limited range, is inclined approximately at a constant inclination relative to a horizontal plane. Furthermore, the training device comprises means for adjusting the rails so as to adjust the constant inclination.

These and other objects, features, and advantages of this invention are evident from the following description of a preferred embodiment of this invention with reference to the accompanying drawings.

DETAILED DESCRIPTION OF PREFERRED EMBODIMENT

Figure 1:
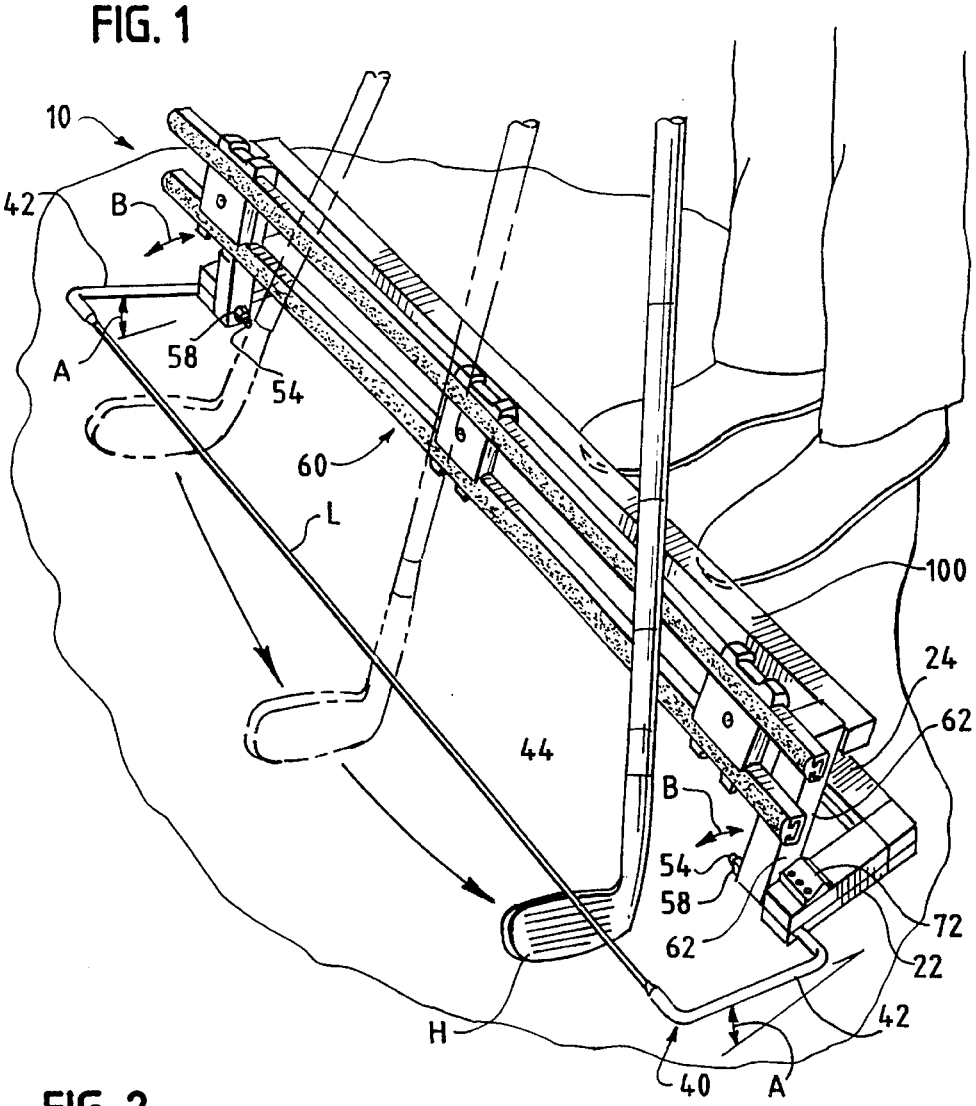
FIG. 1 is a perspective view of a training device embodying this invention, as used to train a golfer to swing a putter correctly. The legs and feet of the golfer are shown fragmentarily. The putter is shown fragmentarily in three different positions.
Figure 2:
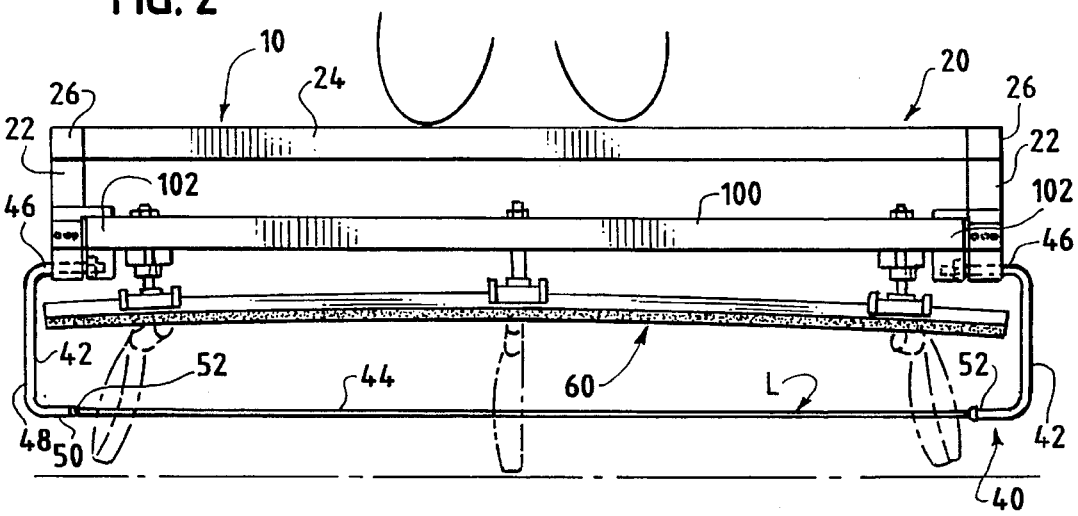
FIG. 2 is a top plan of the training device. The feet of the golfer are shown fragmentarily. The putter is shown fragmentarily in three different positions.
Figure 3:
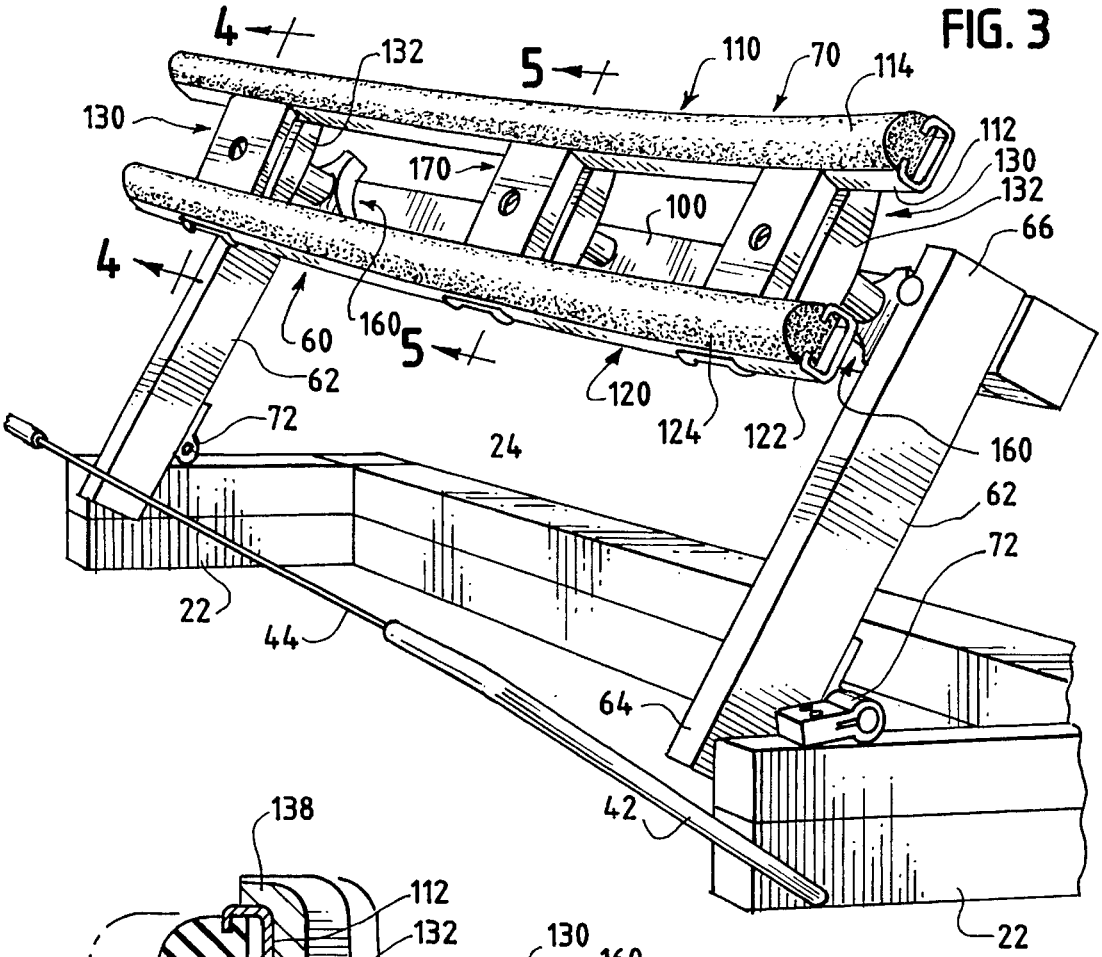
FIG. 3 is an enlarged, fragmentarily, perspective view of the training device, as viewed from a different vantage.

As shown in FIGS. 1 and 2, a device 10 for training a golfer to use a putter P correctly constitutes a preferred embodiment of this invention. Conventionally, the putter P has a head H and a shaft S extending from the head H. Broadly, the training device 10 comprises a frame 20, means 40 for delineating a sight line L, and means 60 for guiding the shaft S in a novel manner as the putter P is swung through a limited range. The limited range includes an intermediate position, in which the head H is positioned in a lowermost position, a subrange of back-swing positions, in which the head H is raised from the lowermost position, and a subrange of follow-through positions, in which the head H is raised from the lower most position.

The frame 20 is fabricated from rectangular metal tubes, as shown, so as to have two side portions 22 parallel to each other and a back portion 24 having two opposite ends 26, each being joined to one of the side portions 22. The opposite ends 26 of the back portion 24 are joined to the side portions 22 by welding or otherwise.

As the means 40 for delineating the sight line L, the training device 10 comprises two side rods 42, each being mounted to one of the side portions 22 of the frame 20, and a cord 44 tied to the side rods 42 so as to extend tautly between the side rods 42. The cord 44 delineates the sight line L. Each side rod 42 is shaped, as shown in FIG. 1, so as to have a proximal portion 46, an intermediate portion 48, and a distal portion 50 parallel to the proximal portion 46 and provided with an annular groove 52, at which the cord 44 is tied to such side rod 42. The side rods 42 are mounted to the side portions 22 of the frame 20, at the proximal portions 46, so as to permit the side rods 42 to be pivotably adjusted, as suggested by curved arrows A in FIG. 1. The proximal portions 46 have threaded ends 54 passing through suitable holes in the side portions 22 and in two side arms 62 described below and receiving threaded nuts 58. The threaded nuts 58 are tightened so as to hold the side rods 42 frictionally once the side rods 42 have been adjusted to selected positions permitting the head H of the putter P to be freely moved beneath the cord 44. To function properly, the side rods 42 should be similarly adjusted so that the cord 44 extends horizontally, whereby the sight line L is horizontal and positioned through the center of the head H of the putter P when viewed from above.

As the means 60 for guiding the shaft S as the putter P is swung through a limited range, the training device 10 comprises the side arms 62 noted above, each having a lower end 64 and an upper end 66, and a rail assembly 70 mounted to the upper ends 66 of the side arms 62. Each side arm 62 is mounted at its lower end 64 to one of the side portions 22 of the frame 20 so as to be pivotably adjustable, as suggested by curved arrows B in FIG. 1, via fictional torque hinges 72, which hold the side arms 62 frictionally once the side arms 62 have been adjusted to selected inclinations. Frictional torque hinges suitable for mounting the side arms 62 to the side portions 22 of the frame 20 are "ST-10" hinges available commercially from CEMA Technologies, Inc. of Bridgeport, Pa.

The rail assembly 70 comprises a cross member 100, an upper rail 110, a lower rail 120, and means for mounting the respective rails 110, 120, to the cross member 100. The cross member 100 is fabricated from a rectangular metal tube and is joined suitably at its opposite ends 102 to the upper ends 66 of the side arms 62. The cross member 100 has two aligned holes 104 near each of the opposite ends 102 and two aligned holes located centrally between the opposite ends 102. The upper rail 110 comprises a metal channel 112 and a polymeric insert 114, which is inserted endwise into the channel 112, and the lower rail 120 comprises a metal channel 122 and a polymeric insert 124, which is inserted endwise into the channel 122. The polymeric inserts 114, 124, are shaped so as to interlock with the metal channels 112, 122, and are extruded from a suitable polymer, such as ultra high molecular weight (UHMH) polyethylene, which is preferred because of its inherent lubricity. Each of the polymeric inserts 114, 124, defines a guiding surface, along which the shank S of the putter is guided in a manner to be later described.

Figure 4:
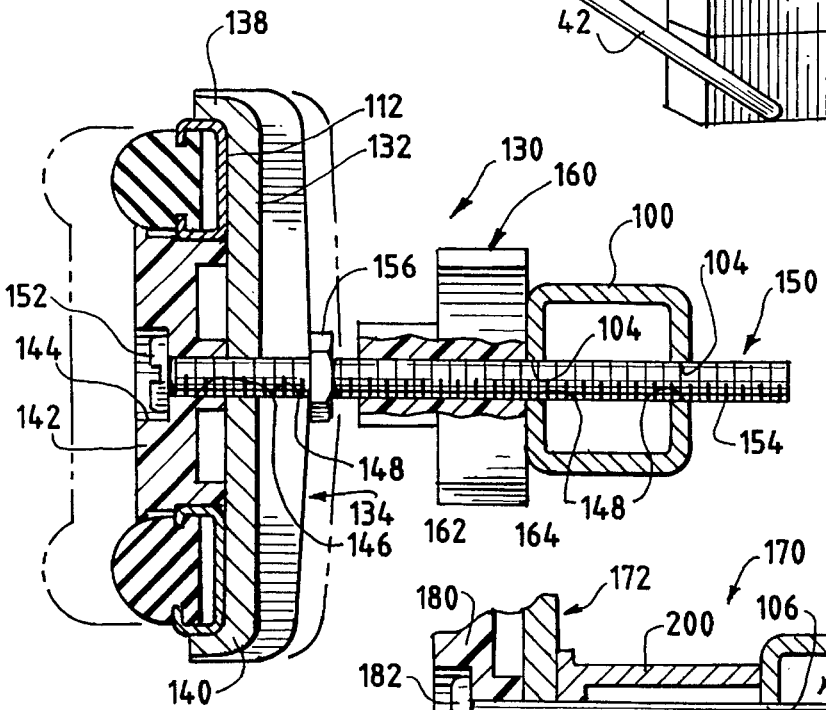
FIG. 4 is a further enlarged, fragmentary, sectional detail taken along line 4—4 in FIG. 3, in a direction indicated by arrows.
Figure 5:
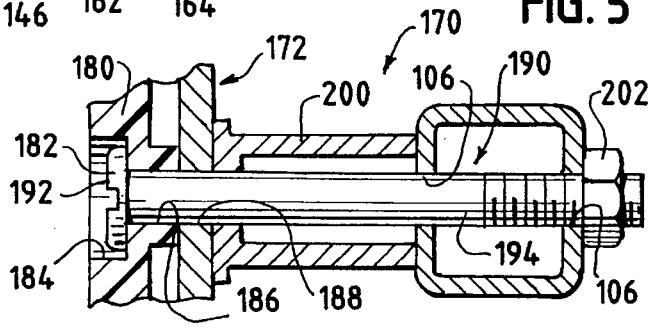
FIG. 5 is a similarly enlarged, fragmentary, sectional detail taken along line 5—5 in FIG. 3, in a direction indicated by arrows.

The means for mounting the respective rails 110, 120, to the cross member 100 comprises two outer, adjustable, rail-mounting means 130 and a center, non-adjustable, rail-mounting means 170. An exemplary one of the outer means 130 is shown in cross-section in FIG. 4. The center means 170 is shown in cross-section in FIG. 5.

Each of the outer means 130 comprises a wide channel 132, which is made from a suitable polymer, such as nylon, and which has an upper flange 138, against which the metal channel 112 of the upper rail 110 is pressed, a lower flange 140, against which the metal channel 122 of the lower rail 120 is pressed, and an elastomeric insert 142, which is compressed slightly between the metal channels 112, 122, so as to press the metal channel 112 against the upper flange 138 and so as to press the metal channel 122 against the lower flange 140. The elastomeric insert 142 is molded from a suitable polymer, such as nylon, so as to have a central recess 144 opening away from the central web 134 and a central hole 146 extending from the central recess 142, through the elastomeric insert 142. The wide channel 132 has a central hold 148, which extends through the wide channel 132, and which is aligned with the central hole 146 and with the nearer two of the aligned holes 104 of the cross member 100.

Each of the outer means 130 further comprises a machine screw 150 having a head 152, which is seated in the central recess 144, and a threaded shank 154, which extends from the head 152, through the central hole 146 of the elastomerie insert 140, through the central hole 148 of the wide channel 132, through a threaded nut 156, through a star wheel 160, and through the nearer two of the aligned holes 148 of the cross member 100. The threaded nut 156 is tightened on the threaded shank 154, against the polymeric cover 134, so as to prevent the machine screw 150 from turning. The star wheel 160 has a polymeric insert 162, which is molded from a suitable polymer, such as nylon, and has a threaded hole 164, through which the threaded shank 154 of the machine screw 150 is threaded.

The center means 170 comprises a wide channel 172, which is similar to the wide channels 132, and an elastomeric insert 180, which is similar to the elastomeric inserts 142. Thus, the elastomeric insert 180 has a central recess 184 opening away from the wide channel 172 and a central hole 186 extending from the central recess 182, through the elastomeric insert 180. The wide channel 172 has a central hole 188, which is aligned with the central hole 186 and with the aligned holes 106 of the cross member 100. The center means 170 further comprises a machine screw 190 having a head 192, which is seated in the central recess 184, and a partly threaded shank 194, which extends from the head 192, through the central hole 186 of the elastomeric insert 180, through the central hole 186 of the wide channel 172, through a spacer 200, through the aligned holes 148 of the cross member 100, and through a threaded nut 202. The threaded nut 202 is tightened on the threaded shank 194, against the cross member 100, so as to rigidify the center means 170.

As shown in the drawings and described above, the rail assembly 70 is adapted from a rail assembly of a type intended to provide guard rails on a packaging machine, bottling machine, or conveyor system and available commercially from Efson Division of Fenner Drives of Wilmington, N.C. It is contemplated that the rail assembly 70 may be substantially simplified, as by combining the respective rails 120, 130, the wide channels 132,. 172, and the elastomeric inserts 140, 180, into a single, molded, polymeric piece.

When the star wheels 160 are turned on the threaded shanks 154 of the machine screws 150 so as to stress the cross member 100, which is held by the center means 170, the respective rails 120, 130, are curved into any of various configurations, which include the configuration shown in FIG. 2, such that the shaft S of the putter P when guided along the guiding surfaces defined by the polymeric inserts 114, 124, of the respective rails 120, 130, is in a position farthest from the sight line L when the putter P is positioned in the intermediate position with the head H positioned in the lowermost position, such that the shaft S is positioned in positions closer to the sight line L when the putter P is swung through the subrange of back-swing positions with the head H raised from the lowermost position, and such that the shaft S is positioned in positions closer to the sight line L when the putter P is swung through the subrange of follow-through positions with the head H raised from the lowermost position. If the star wheels 160 are adjusted differently, the respective rails 120, 130, can be assymetrically curved so as to allow for different swinging patterns including inside-square-inside, square-square-square, and inside-square-square, whichever a golfer or a teaching professional may prefer. Preferably, the star wheels 160 are adjusted so that the respective rails 120, 130, are arranged such that an imaginary line tangent to the guiding surfaces of the respective rails 120, 130, in an imaginary plane intersecting the respective rails 120, 130, at any position within the limited range, is inclined approximately at a constant inclination relative to a horizontal plane.

Figure 6:
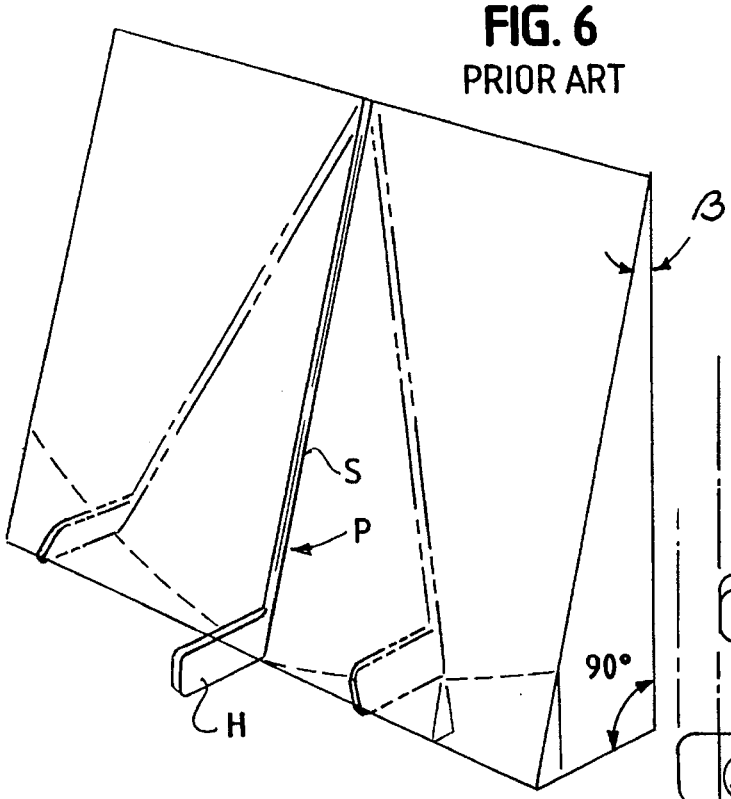
FIG. 6 PRIOR ART
FIG. 6 is a simplified, diagrammatic, perspective view of a putter being swung, as guided by a training device exemplifying prior art.
Figure 8:
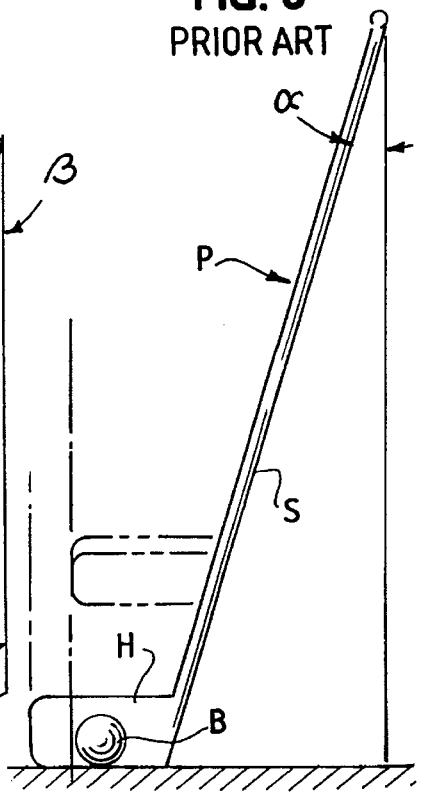
FIG. 8 PRIOR ART
FIG. 8 is a simplified, diagrammatic, side elevation of a putter being swung against a golf ball, as guided by the training device exemplified in FIG. 6.
Figure 7:
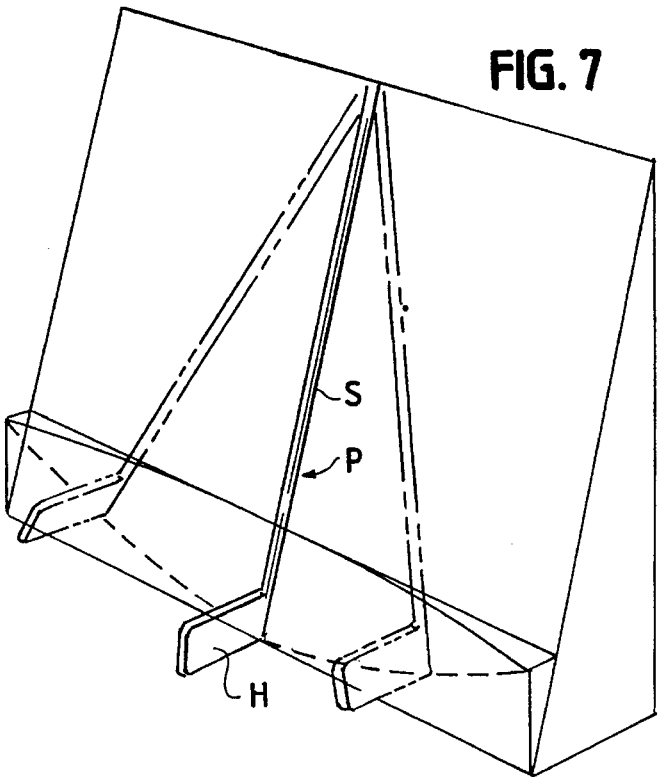
FIG. 7 is a simplified, diagrammatic, perspective view of a putter being swung, as guided by the training device shown in FIGS. 1 through 5.
Figure 9:
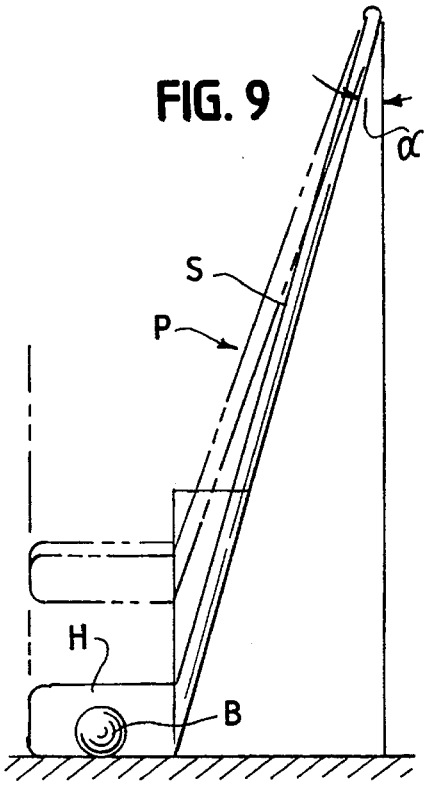
FIG. 9 is a simplified, diagrammatic, side elevation of a putter being swung, as guided by the training device shown in FIGS. 1 through 5.
Figure 10:
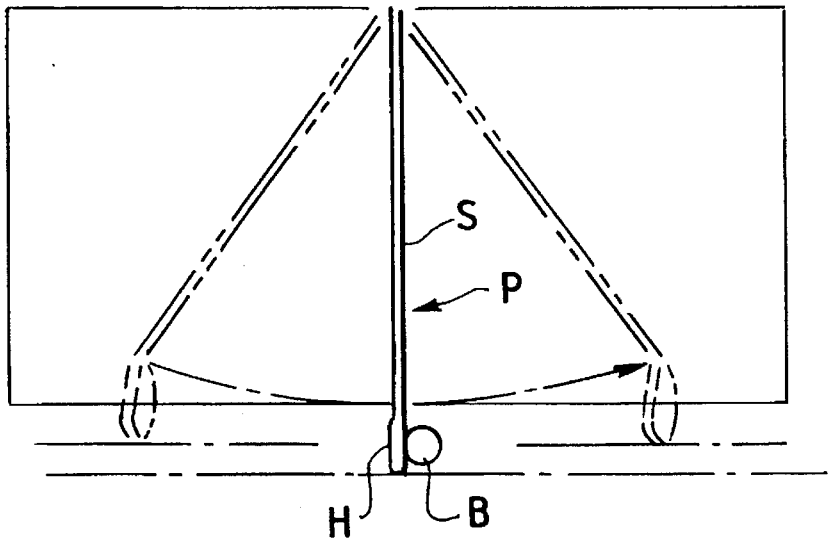
FIG. 10 PRIOR ART
FIG. 10 is a simplified, diagrammatic, top plan of a putter being swung against a golf ball, as guided by the training device exemplified in FIG. 6.
Figure 11:
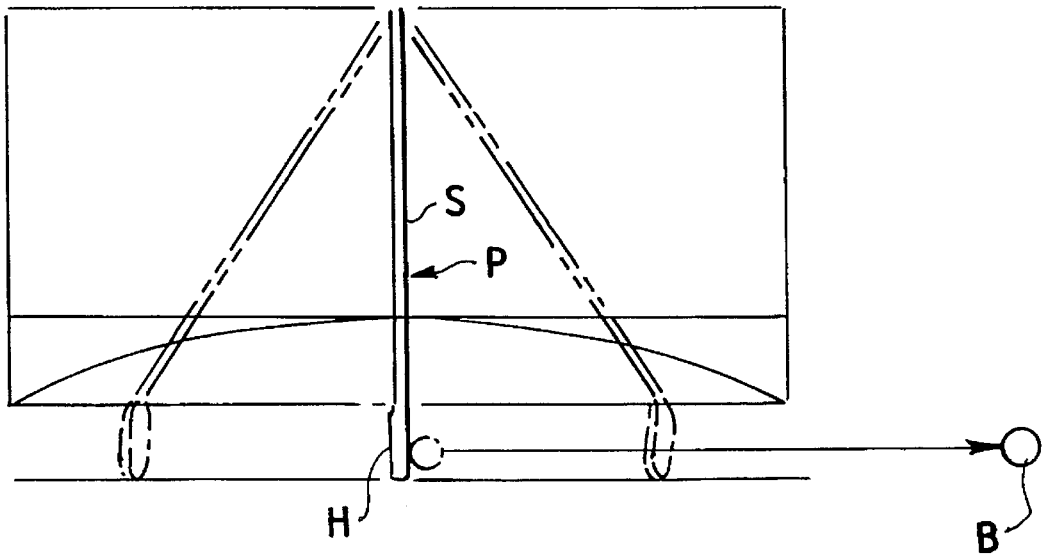
FIG. 11 is a simplified, diagrammatic, top plan of a putter being swung against a golf ball, as guided by the training device shown in FIGS. 1 through 5.

It is informative to compare a training device exemplifying prior art, as shown diagrammatically in FIGS. 6, 8, and 10, with the training device 10, as shown diagrammatically in FIGS. 7, 9, and 11, both with the putter P noted above and with a golf ball B. In the training device exemplifying prior art, as shown, the shaft S of the putter P is guided along an inclined plane defining an angle $\alpha$ with a vertical plane. When viewed vertically downwardly, a point on the head H of the putter P does not appear to travel in a straight line but appears to travel along a curved path, as suggested in FIG. 8. In the training device 10, as shown, the shaft S of the putter P is guided along a curved surface. When viewed vertically downwardly, a point on the head H of the putter P appears to travel in a straight line, as suggested in FIG. 9. It is easier to train a golfer to swing a putter so as to move the head of the putter correctly with the training device 10.

Various modifications may be made in the preferred embodiment described above without departing from the scope of this invention.

I claim:

1. A training device for training a golfer to use a putter correctly, the putter having a head and a shaft extending from the head, the training device comprising means for delineating a sight line and means for guiding the shaft as the putter is swung through a limited range, the limited range including an intermediate position, in which the head is positioned in a lowermost position, the limited range including a subrange of back-swing positions, in which the head is raised from the lowermost position, the limited range including a subrange of follow-through positions, in which the head is raised from the lowermost position, the guiding means including a rail defining the limited range and having a guiding surface, along which the shaft is guided with head below the sight line, the rail being curved into a given configuration such that the shaft when guided along the guiding surface is positioned in a position farthest from the sight line when the putter is positioned in the intermediate position with the head positioned in the lowermost position and such that the shaft is positioned in positions closer to the sight line when the putter is swung through the subrange of back-swing positions with the head raised from the lowermost position.

2. The training device of claim I wherein the rail is curved into the given configuration such that the shaft when guided along the guiding surface also is positioned in positions closer to the sight line when the putter is swung through the subrange of follow-through positions with the head raised from the lowermost position.

3. The training device of claim 2 wherein the rail is one of a pair of similar rails, each having such a guiding surface, the rails being curved similarly and being spaced from each other.

4. The training device of claim 3 wherein the rails are arranged such that an imaginary line tangent to the guiding surfaces of the rails, in an imaginary plane intersecting the rails at any position within the limited range, is inclined approximately at a constant inclination relative to a horizontal plane.

5. The training device of claim I wherein the rail is one of a pair of similar rails, each having such a guiding surface, the rails being curved similarly and being spaced from each other.

6. A training device for training a golfer to use a putter correctly, the putter having a head and a shaft extending from the head, the training device comprising means for delineating a sight line and means for guiding the shaft as the putter is swung through a limited range, the sight line being horizontal, the limited range including an intermediate position, in which the head is positioned in a lowermost position, the limited range including a subrange of back-swing positions, in which the head is raised from the lowermost position, the limited range including a subrange of follow-through positions, in which the head is raised from the lowermost position, the guiding means including a rail defining the limited range and having a guiding surface, along which the shaft is guided with head below the sight line, the rail being adapted to be adjustably curved into any of various configurations such that the shaft when guided along the guiding surfaces is positioned in a position farthest from the sight line when the putter is positioned in the intermediate position with the head positioned in the lowermost position and such that the shaft is positioned in positions closer to the sight line when the putter is swung through the subrange of back-swing positions with the head raised from the lowermost position.

7. The training device of claim 6 wherein the rail is adapted to be adjustably curved into any of various configurations such that the shaft when guided along the guiding surface also is positioned in positions closer to the sight line when the putter is swung through the sub range of follow-through positions with the head raised from the lowermost position.

8. The training device of claim 7 wherein the rail is one of a pair of similar rails, each having such a guiding surface, the rails being curved similarly and being spaced from each other.

9. The training device of claim 8 wherein the rails are arranged such that an imaginary line tangent to the guiding surfaces of the rails, in an imaginary plane intersecting the rails at any position within the limited range, is inclined approximately at a constant inclination relative to a horizontal plane.

10. The training device of claim 6 wherein the rail is one of a pair of similar rails, each rail having such a guiding surface, the rails being adapted to be similarly curved and being spaced from each other.

11. The training device of claim 8 further comprising means for adjusting the rails so as to adjust the constant inclination.

* * * * *